US005802741A

United States Patent [19]

Turner et al.

[11] Patent Number: 5,802,741

[45] Date of Patent: Sep. 8, 1998

[54] SNOWBOARD BOOT

[75] Inventors: Brent H. Turner, Seattle, Wash.; Antonin A. Meibock, Cleveland, Ohio; John E. Svensson, Seattle, Wash.

[73] Assignee: K-2 Corporation, Vashon, Wash.

[21] Appl. No.: 127,584

[22] Filed: Sep. 27, 1993

Related U.S. Application Data

[63] Continuation-in-part of Ser. No. 120,629, Sep. 13, 1993, Pat. No. 5,452,907, Ser. No. 100,745, Aug. 2, 1993, abandoned, and Ser. No. 94,576, Jul. 19, 1993, Pat. No. 5,437,466.

[51] Int. Cl.[6] ..... A43B 5/04

[52] U.S. Cl. ..... 36/117.3; 36/45; 36/115

[58] Field of Search ..... 36/115, 55, 117.2, 36/117.1, 117.3, 118.2, 118.4, 45

[56] References Cited

U.S. PATENT DOCUMENTS

| | | | |
|---|---|---|---|
| D. 325,663 | 4/1992 | Barret et al. | D2/276 |
| D. 327,360 | 6/1992 | Graham | D2/276 |
| 1,546,551 | 7/1925 | Petri | 36/115 |
| 3,061,325 | 10/1962 | Glass | 280/613 |
| 3,852,896 | 12/1974 | Pyzel et al. | 36/117 |
| 3,955,825 | 5/1976 | Kubelka et al. | 280/618 |
| 4,177,584 | 12/1979 | Beyl | 36/117 |
| 4,185,851 | 1/1980 | Salomon | 280/613 |
| 4,191,395 | 3/1980 | Salomon | 280/613 |
| 4,255,876 | 3/1981 | Johnson | 36/45 X |
| 4,290,213 | 9/1981 | Salomon | 36/117 |
| 4,334,367 | 6/1982 | Salomon | 36/117 |
| 4,351,120 | 9/1982 | Dalebout | 36/117.3 |
| 4,454,663 | 6/1984 | Graillat et al. | 36/120 |
| 4,571,858 | 2/1986 | Faulin | 36/117.3 X |
| 4,653,203 | 3/1987 | De Mattheis | 36/117 |
| 4,768,804 | 9/1988 | With | 280/614 |
| 4,846,492 | 7/1989 | Bataille | 280/613 |
| 4,973,073 | 11/1990 | Raines et al. | 280/624 |
| 4,979,760 | 12/1990 | Derrah | 280/607 |
| 5,004,262 | 4/1991 | Provence et al. | 280/615 |
| 5,007,656 | 4/1991 | Girault et al. | 280/615 |
| 5,035,443 | 7/1991 | Kincheloe | 280/618 |
| 5,105,565 | 4/1992 | Barret | 36/117 |
| 5,145,202 | 9/1992 | Miller | 280/613 |
| 5,171,033 | 12/1992 | Olson et al. | 280/11.22 |
| 5,177,884 | 1/1993 | Rullier | 36/117 |
| 5,190,310 | 3/1993 | Haughlin et al. | 280/615 |
| 5,299,823 | 4/1994 | Glaser | 280/625 |
| 5,331,752 | 7/1994 | Johnson et al. | 36/115 X |
| 5,380,020 | 1/1995 | Arney et al. | 36/115 X |
| 5,435,080 | 7/1995 | Meiselman | 36/115 X |
| 5,437,466 | 8/1995 | Meibock et al. | 36/115 X |
| 5,499,461 | 3/1996 | Danezin et al. | 36/55 X |

FOREIGN PATENT DOCUMENTS

| | | |
|---|---|---|
| 556799 | 8/1993 | European Pat. Off. . |

*Primary Examiner*—B. Dayoan

*Attorney, Agent, or Firm*—Christensen O'Connor Johnson & Kindness PLLC

[57] ABSTRACT

A boot is disclosed for use with a snowboard having binding means for attachment to the boot. The boot includes a base, a highback, and an upper. The base includes a binding receiving plate for attaching the boot to the binding means on the snowboard. The base also has toe and heel ends. The base is formed with a toecap at the toe end and as a heel counter at the heel end. Tread projects from the bottom of the base for traction when the boot is not attached to the snowboard. The highback extends upwardly from the heel counter of the base. The highback provides aft support to the user. The upper is fixedly attached to the base and is arranged and configured to receive the foot and ankle of the user. The upper has a rearward side adjacent the highback. The upper is more flexible than the base and the highback. A base strap is connected to opposing sides of the base and extends across a portion of the upper.

30 Claims, 12 Drawing Sheets

SNOWBOARD BOOT

CROSS REFERENCE TO RELATED APPLICATIONS

The present application is a continuation in part of Ser. No. 08/120,629 filed Sep. 13, 1993, now U.S. Pat. No. 5,452,907, application Ser. No. 08/100,745 filed on Aug. 2, 1993, now abandoned and Ser. No. 08/094,576 filed on Jul. 19, 1993, now U.S. Pat. No. 5,437,466.

FIELD OF THE INVENTION

The present invention relates generally to boots or shoes designed to provide ankle support for winter sporting activities and, more particularly, to sport boots and bindings for releasable attachment to snow boards and the like.

BACKGROUND OF THE INVENTION

Snowboards have been in use for a number of years, and snowboarding has become a popular winter sports activity. A snowboard is controlled by weight transfer and foot movement, both lateral and longitudinal. Precision edge control is especially important in alpine snowboarding activities where carving, rather than sliding, through the snow is desirable. Therefore, small movements of the snowboarder's feet within the boots can have significant effects on the user's control over the snowboard's movement. However, boot flexibility is also important for many recreational and freestyle snowboarding activities. Despite the widespread acknowledgment of the importance of these two desirable factors of edge control and flexibility, snowboard boots generally do not satisfactorily provide both.

To provide control, mountaineering-type boots have been used, especially in Europe. These boots include a molded plastic, stiff outer shell and a soft inner liner. The boots are mounted on the snowboard using mountaineering or plate bindings. Plate bindings are fastened to the board under the fore and aft portions of the sole of the boot and typically provide both heel and toe bails to secure the boot in place, usually without any safety release mechanism. These boots are stiff enough to provide the desired edge control and stability for carving. However, they are too stiff to allow significant lateral flexibility, a key movement in the sport that is essential for freestyle enthusiasts and desirable for all-around snowboarders. As a result, the mountaineering-type boots feel too constraining to many snowboarders.

Freestyle snowboarding requires more flexibility of the ankle of the snowboarder relative to the board than the mountaineering-type boots allow. Even all-around recreational snowboarding requires some boot flexibility. The stiff mountaineering-type boots offer little lateral flexibility and only marginal fore and aft flexibility. Because of the desire for flexibility, most American snowboarders have opted for an insulated snow boot combined with "soft-shell" bindings. These bindings have rigid bases attached to the board, highback shells, straps to wrap around the boot, and buckles to secure the straps in place. The boots, when removed from the bindings, are standard insulated snow boots or slightly modified snow boots. The flexibility gained from the soft boot and relatively soft binding results in less edge control than a mountaineering-type boot and difficult entry and release. The snowboarder may attempt to gain more edge control by tightening his binding straps around his boots. However, such overtightening may seriously sacrifice comfort. A related problem occurs every time the snowboarder reaches flat terrain, the bottom of the hill, or the chairlift. The snowboarder must unbuckle the straps of at least one binding to scoot along skateboard-style by pushing with the released foot. This may be time consuming and cumbersome since proper securing and tightening of the binding is difficult. Disembarking from the cnairlift with only one boot nonreleasably attached to the snowboard is also hazardous since the leverage of the board on one ankle or knee could easily cause injury in a fall.

Manufacturers' attempts at providing both edge control and flexibility have centered around plate bindings for use with stiff mountaineering-type boots. Plate bindings offer ease of entry and release—no buckles to unsnap or straps to tighten. They may also be made releasable in response to forces placed thereon during use. Plate binding manufacturers have approached the problem of lateral flexibility from several different angles. For example, one type of binding, made by Emery, offers a two-piece plate—one for the heel and the other for the toe. Under each toeplate and heelplate is a half-inch high rubber pad shaped in the form of a rectangle. The rubber pad is supposed to act as a shock absorber and provide side-to-side flex. Other attempts have used adaptations of Swiss mountaineering bindings. A hard plate is mounted to the board. Two rectangular boxes—at the toe and heel—cradle a spring steel cage. Bails are connected to the cage and act as cantilevers in creating a side-to-side flex. However, such attempts may sacrifice some edge control by making the interface between boot and board too soft in order to achieve the desired lateral flexibility. They are also expensive and are only manually releasable (i.e., not a releasable safety binding).

In general, the public has not been satisfied with the use of binding plates to solve the flexibility/control dichotomy. Those serious snowboarders who desire to both carve racing turns and "board" freestyle, purchase two boards and two sets of bindings and boots. Those who are simply recreational boarders or cannot afford the two-board luxury, generally settle on one type or the other, and thus sacrifice performance of one type or the other.

The boot of the present invention solves the flexibility/control problem by proceeding in a different direction from past attempts. The invention provides a boot that allows most of the flexibility of the soft shell boot/binding while retaining the advantages of control and ease of entry and release of the mountaineering-type boot/binding arrangement. The invention thus allows greater comfort, convenience, all-around performance, and safety.

SUMMARY OF THE INVENTION

The present invention provides snowboard boots that are flexible while giving proper support for edge control of the snowboard. The boots are also much easier to use than a typical freestyle boot as the soft shell binding is not needed and a step-in binding can be used. The snowboard boot includes a base, a nonrigid upper, and a support member. The base has means for attachment to the snowboard and provides a walking surface for the user when the boot is detached from the snowboard. The nonrigid upper is attached to the base. The upper is adapted to receive the foot and ankle of a user, is formed of a flexible and pliable material, and has a front, a back, and two lateral sides. The support member is attached to and extends upwardly from the base. The support member is disposed adjacent at least a portion of the back of the upper. Preferably, the support member is constructed of a material with greater rigidity than the upper. The support member thus provides aft support to the upper.

A tread portion extends from the bottom of the base. The tread portion projects downwardly, away from the foot of the user and surrounds the attachment means on the base for attachment of the boot to a snowboard. In one preferred embodiment of the invention, the base is rigid and the tread portion is flexible such that the tread portion allows limited pivotal movement of the base about the connection of the base to the snowboard. Thus, this arrangement permits some lateral movement of the boot when coupled to the snowboard.

In another aspect of the preferred embodiment of the invention, the attachment means are held within at least one recessed portion of the bottom of the base. The treads extend below the attachment means such that the treads contact the ground before the attachment means when the boot is not attached to the snow board. The base preferably includes a first recessed portion generally beneath the ball of the foot of the user and a second recessed portion generally beneath the heel of the foot of the user. The recessed portions hold the attachment means.

In an alternate embodiment of the invention the base is flexible such that it allows limited pivotal movement of the base about the connection to the snowboard when coupled to the snowboard.

In the preferred embodiment of the invention the support member is formed of a plastic material and includes a strap for securing the support member securely around a portion of the upper. Also in the preferred embodiment, the upper may be partially constructed of leather and partially constructed of a synthetic mesh material.

In one aspect of the preferred embodiment of the invention, the base includes a heel counter. The support member extends from the heel counter. Preferably, the support member is pivotally attached to the heel counter. The base also includes a toe portion extending at least partially around the sides of the ball of the foot of the user. The support member also includes a upper stop extending from the back of the support member. The heel counter likewise includes a lower stop extending from the back of the heel counter beneath the upper stop. The stops are arranged and configured for abutment with each other to limit the aft pivotal movement of the support member relative to the base.

In one preferred embodiment of the invention the boot includes a strap extending from one side of the base over a portion of the upper to the opposing side of the base. The strap is connected to the heel counter of the base. The strap includes an adjustable buckle on one end for tightening the strap over a portion of the upper to secure the user's foot.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
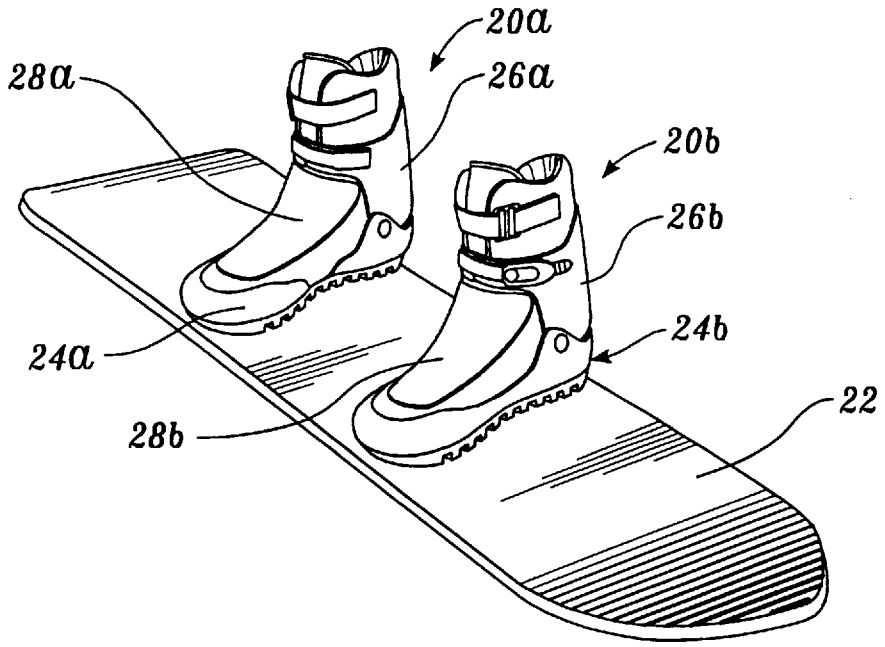
FIG. 1 is a perspective view of one embodiment of the snowboard boots showing the boots attached to a snowboard.

Referring to FIG. 1, boots 20 of the present invention are illustrated in a ready-to-ride position attached to a snowboard 22. Each of boots 20 includes a base 24, a highback 26, and an upper 28. The foot of the user is cupped by base 24. Highback 26 is pivotally connected to base 24 and extends behind and partially on the sides of upper 28. Upper 28 is fixedly secured to base 28. Thus, snowboard boots 20 are provided that combine a soft upper with the support of a soft shell binding built right into the boot itself. With this arrangement, the user can conveniently use standard step-in bindings or other specialized step-in bindings discussed below.

Figure 2:
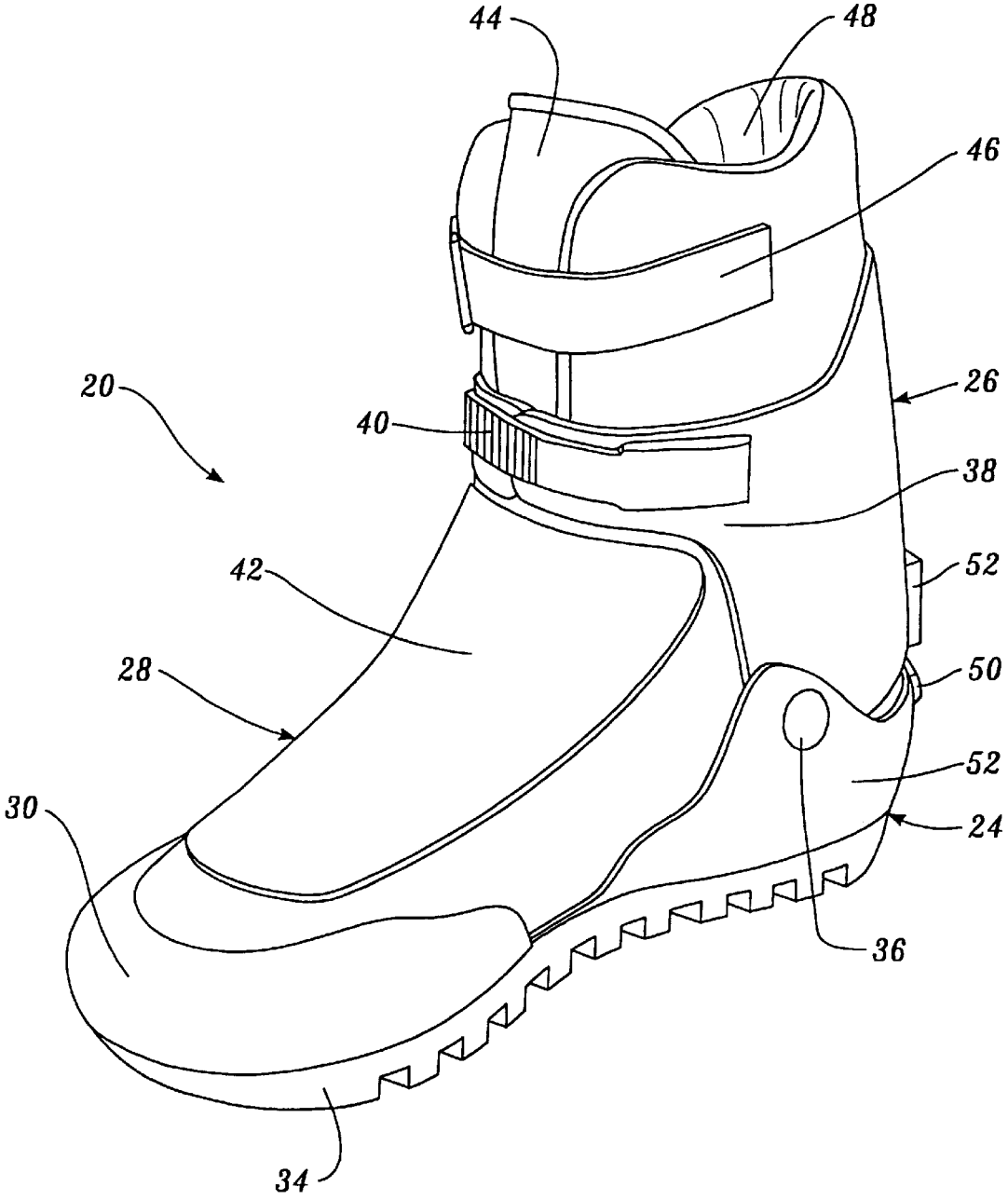
FIG. 2 is a perspective view of the right boot illustrated in FIG. 1.
Figure 3:
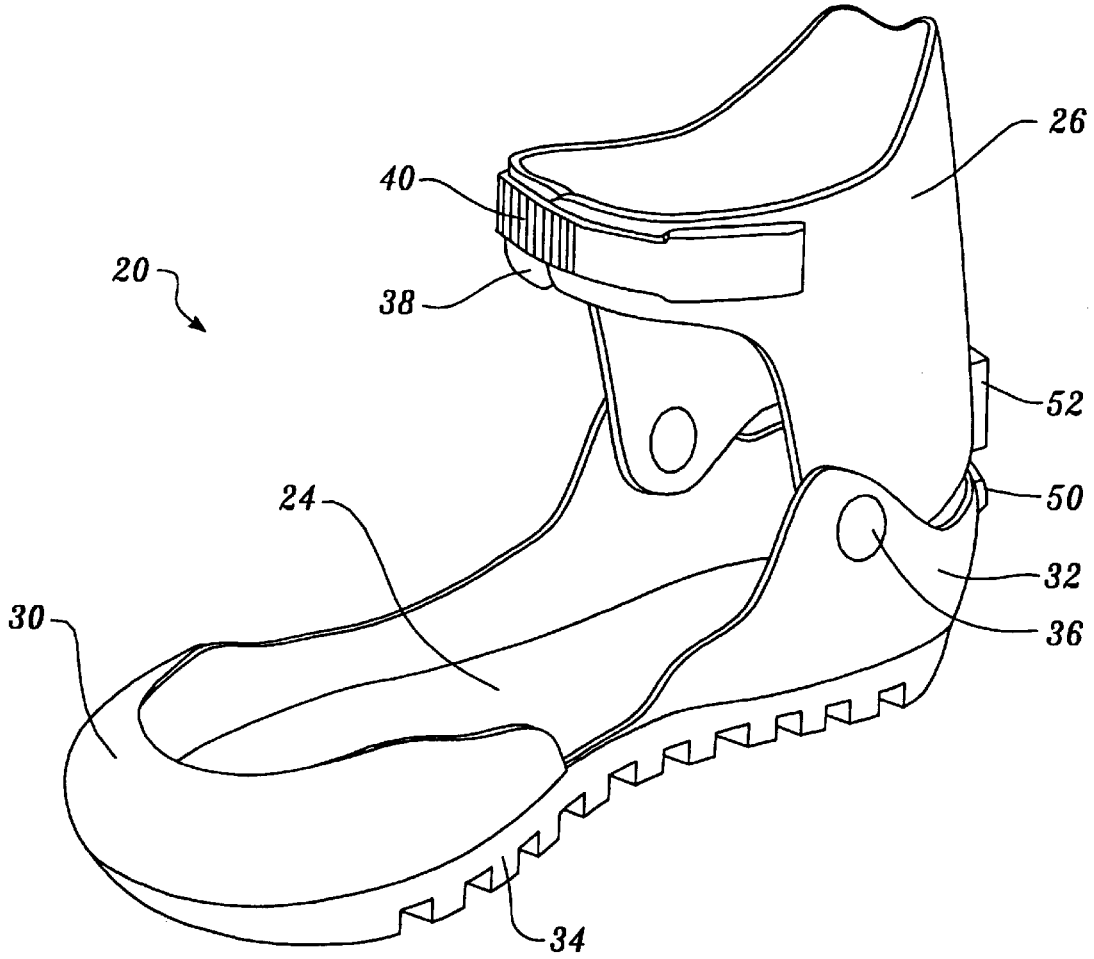
FIG. 3 is a perspective view of the base and the highback of the boot illustrated in FIG. 2.

Referring to FIGS. 2 and 3, the details of boot 20 will be discussed in more detail. Base 24 is preferably constructed of a semirigid material that allows some flex and is resilient. Base 24, for example, may have a base construction similar to the sole construction of either hiking or mountaineering boots. Base 24 includes a toecap 30, a heel counter 32, and tread 34. Toecap 30 is preferably an integrally formed portion of base 24. Toecap 30 surrounds the toe or forward end of upper 28. Alternatively, toecap 30 may not be used or may be formed of a different material from the rest of base 24, such as rubber. The function of toecap 30 is to protect the forward end of upper 28 from wear and water. In some boot-to-snowboard arrangements toecap 30 may slightly extend over the edge of snowboard 22. Thus, toecap 30 would function to protect not only upper 28, but also the foot of the user from injury. Toecap 30 also extends around the side of the ball of the foot of the user. This arrangement adds additional lateral and torsional support to the foot of the user.

Base 24 also includes a heel counter 32 extending upwardly from the heel or rearward end of base 24. Heel counter 32 surrounds and cups the heel portion of upper 28 and provides lateral support to the heel of the user. As with toecap 30, heel counter 32 is preferably formed as an integral part of base 24. Alternatively, however, heel counter 32 could be constructed of a different material and attached to base 24.

Tread 34 extends downwardly from base 24. Tread 34 is preferably formed of a different material than the remainder of base 24. The construction of tread 34 is preferably like that of conventional snow boots such as those sold under the Sorels name. Tread 34 may alternatively be constructed of a Vibram rubber, as commonly used on hiking boots; base 24 may also include a metal or plastic composite shank. The toe end of tread 34 angles upwardly toward toecap 30 so as to not interfere with edging of the snowboard if the toe end of boot 20 extends slightly over the edge of the snowboard. The heel end of tread 34 also angles upwardly toward heel counter 32 at an angle of about 45 degrees.

Highback 26 is pivotally connected to heel counter 32 by a highback pivot 36. This pivot is preferably a heavy-duty rivet, but may alternatively be any other type of conventional pivoting fastener connection. In the alternative embodiments, discussed below, highback pivot 36 may be shifted rearwardly or may not be used at all. Heel counter 32 includes an upward projection to allow highback pivot 36 to be placed just beneath the ankle bone of the user for proper pivotal movement of highback 26. Highback 26 is preferably formed of a resilient plastic material that is rigid enough to provide the desired ankle support to the user. Highback 26 extends upwardly from heel counter 32 adjacent the rear and portions of the preferably provide Highback 26 preferably provides greater aft support than lateral support, as will be explained below.

In the embodiment illustrated in FIG. 2, highback 26 includes a cuff 38 that extends completely around upper 28 above the ankle of the user. A highback strap 40 is attached to cuff 38 to fasten the opposing ends of cuff 38 together and help secure the foot of the user within upper 28.

Upper 28 is fixedly attached to base 24 by being secured beneath the last (not shown) of base 24. Toecap 30 and heel counter 32 may also be glued to upper 28. However, highback 26 is preferably not fixedly attached to upper 28, to allow for relative movement between the two. Upper 28 extends above highback 26. Upper 26 also includes laces (not shown) and lace cover 42 to protect the laces and the foot of the user from snow, ice, and entering moisture. Lace cover 42 is connected to upper 28 adjacent toecap 30 and is held in place over the laces by hook-and-loop fasteners (not shown) under its edges. Upper 28 is preferably constructed principally of leather, but may alternatively be formed from ballistic nylon or other flexible, natural or manmade material. A conventional tongue 44 is also provided within upper 28.

In the embodiment shown in FIG. 2, an upper strap 46 is fastened between the opposing sides of upper 28 above cuff 38. Upper strap 46 helps secure the top portion of upper 28 to the leg of the user. Upper strap 46 uses a hook-and-loop type fastener and folds back on itself after being threaded through a buckle (not shown). A liner 48 including padding is sewn within upper 28 to receive, cushion, and insulate the foot of the user.

One other feature of boot 20 illustrated in FIGS. 2 and 3 is a bottom lip 50 and a stop block 52. Bottom lip 50 is formed integrally from the rearward edge of heel counter 32. Bottom lip 50 projects outwardly. Stop block 52 is fastened to the rearward side of highback 26 directly above bottom lip 50. As the lower edge of stop block 52 contacts the upper edge of bottom lip 50, pivotal rotation of highback 26 is stopped. The position of stop block 52 can be changed to vary the angle of highback 26 for greater or less forward lean. Stop block 52 and bottom lip 50 are seen in more detail in FIG. 9.

Figure 4A:
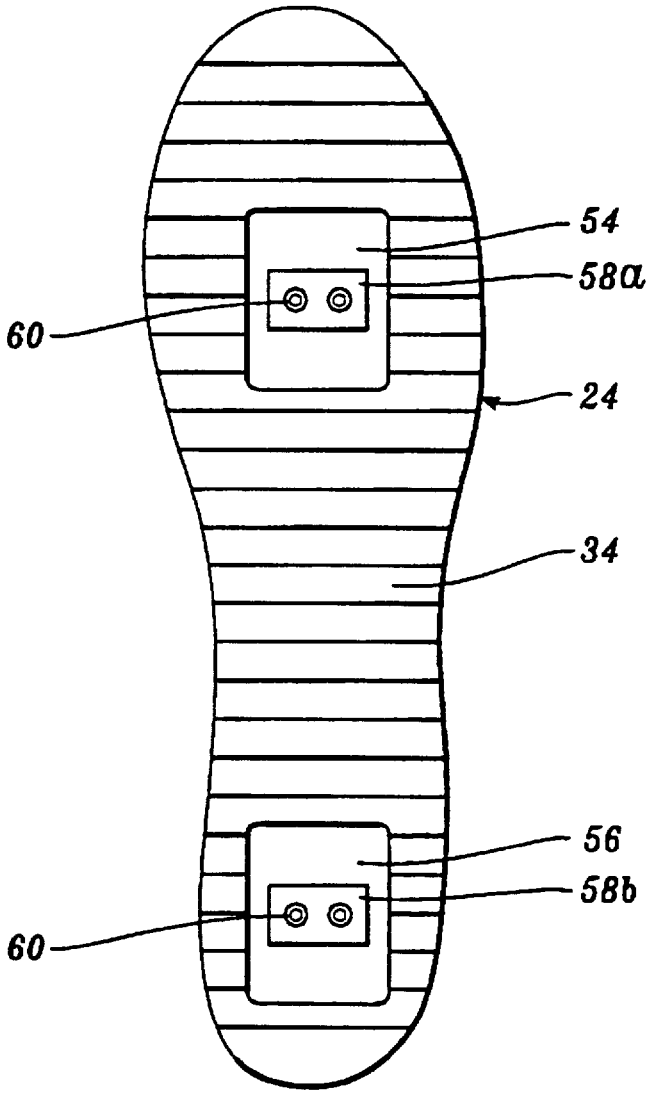
FIG. 4A is a bottom view of the boots illustrated in FIGS. 1 through 3, showing binding attachment plates within recesses.
Figure 4B:
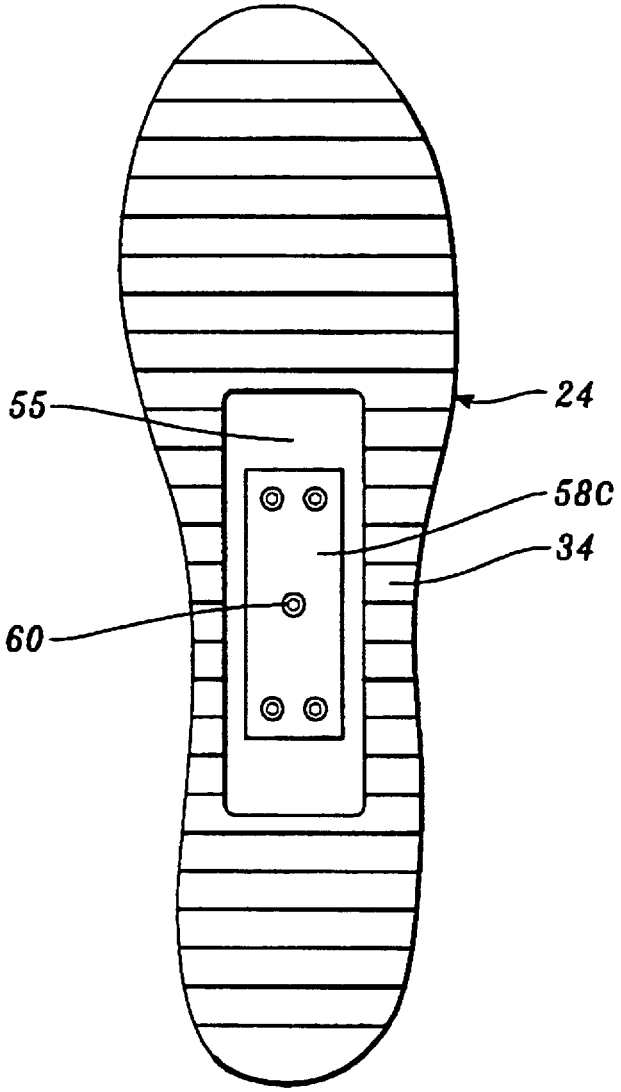
FIG. 4B is a bottom view of a second embodiment of the boot, showing one binding attachment plate within a recess.

Two different embodiments of the bottom of boot 20 are illustrated in FIGS. 4A and 4B. A basic tread pattern is shown in FIGS. 4A and 4B, although alternatively any tread pattern could be used. In the embodiment shown in FIG. 4A, base 24 includes a forward recess 54 and a rearward recess 56. Recesses 54 and 56 are surrounded by tread 34. Recesses 54 and 56 are preferably rectangular but could be any configuration needed to interface with step-in snowboard bindings. Forward and rearward boot plates 58*a* and 58*b* are mounted inside recesses 54 and 56. Boot plates 58*a* and 58*b* are secured by fasteners 60. Boot plates 58*a* and 58*b* are also rectangular, although somewhat smaller than recesses 54 and 56 so as to allow room for the jaws of snowboard bindings to grasp the edges of boot plates 58*a* and 58*b*. Preferably, the minor axis of boot plates 58*a* and 58*b* is parallel to the longitudinal axis of base 24.

In the embodiment shown in FIG. 4B, base 24 includes a single recess 55 surrounded by tread 34. Recess 55 is preferably rectangular but alternatively could be any shape desired to interface with step in snowboard bindings. Boot plate 58*c* is mounted inside recess 55 and secured by fasteners 60. Boot plate 58*c* is also preferably rectangular and is somewhat smaller than recess 55. The major axis of boot plate 58*c* is preferably parallel to the longitudinal axis of base 24.

Figure 5:
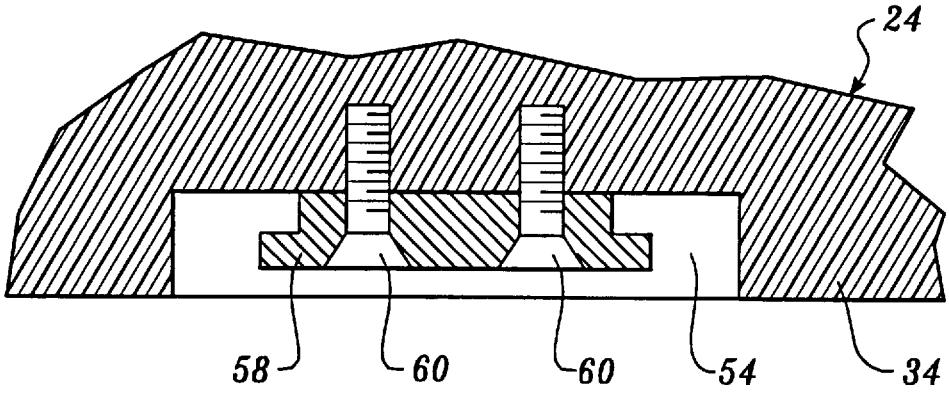
FIG. 5 is a cross-sectional view of the binding attachment plate secured to the base of the boot.

FIG. 5 illustrates a cross-sectional view of boot plate 58. In cross section, boot plate 58 has an upside-down T shape providing projecting edges onto which the jaws of the snowboard binding may grasp. FIG. 5 also shows how the bottom of tread 34 projects beneath the level of boot plate 58.

Figure 6A:
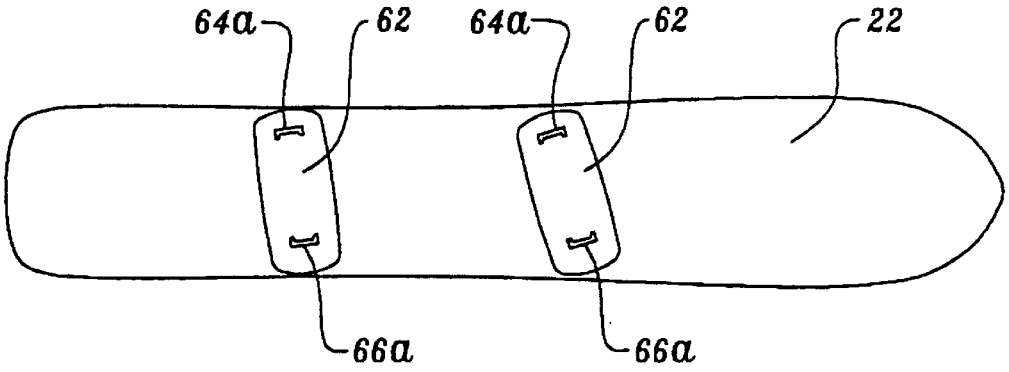
FIG. 6A is a top view of a snowboard illustrating one embodiment of the bindings.
Figure 6B:
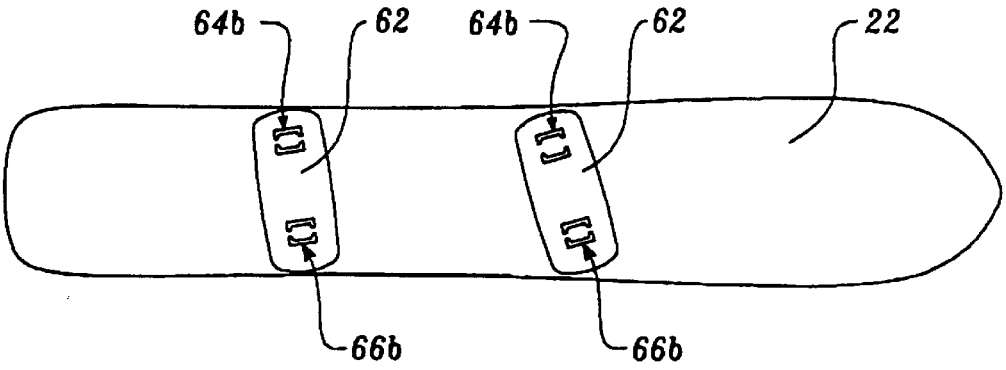
FIG. 6B is a top view of a snowboard illustrating another embodiment of the bindings.
Figure 6C:
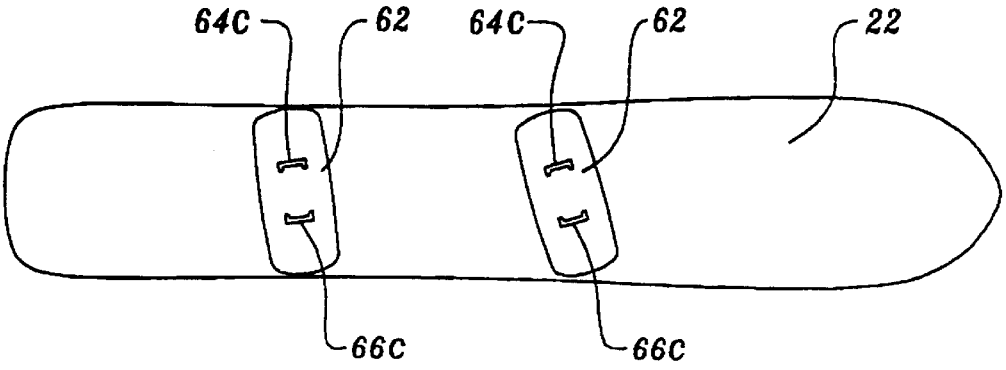
FIG. 6C is a top view of a snowboard illustrating an embodiment of the bindings to be used with the boot shown in FIG. 4B.

FIGS. 6A, 6B, and 6C illustrate one type of binding in three different arrangements that may be used in connection with boot 20 of the present invention. The bindings shown are step-in bindings similar in some ways to step-in ski bindings. A binding plate 62 is fastened to snowboard 22. Binding plate 62 is large enough for most of tread 34 to fit thereon. Toe bindings 64 and heel bindings 66 are fastened to binding plates 62. Toe and heel bindings are spring-biased jaws that engage boot plates 58 to hold boot 20 in place. The jaws of bindings 64 and 66 grip around the edges of boot plates 58 and limit the movement of boot plates 58 in all directions.

The arrangement shown in FIG. 6A may be used when base 24 of boot 20 is rigid enough to hold the forward and rearward boot plates 58 at a constant distance apart. A less rigid base 24 may be used with bindings 64B and 66B illustrated in FIG. 6B, since forward and rearward plates 58 are held on all sides by individual bindings. FIG. 6C illustrates an arrangement of bindings 64C and 66C for attachment to a single boot plate 58C as illustrated in FIG. 4B. One toe binding 64C attaches to the front of boot plate 58C and one heel binding 66C attaches to the rear of boot plate 58C. Other arrangements are obviously possible. Currently available plate bindings may also be used to hold boot 20 to snowboard 22. For this purpose ridges could be provided at the toe and heel of boot 20 to receive the toe and heel bails of such conventional plate bindings, such as those made by Emery or Burton, to be used with mountaineering-type boots. A less rigid base 24 for boot 20 may be desirable for comfortable walking when not snowboarding.

Figure 7:
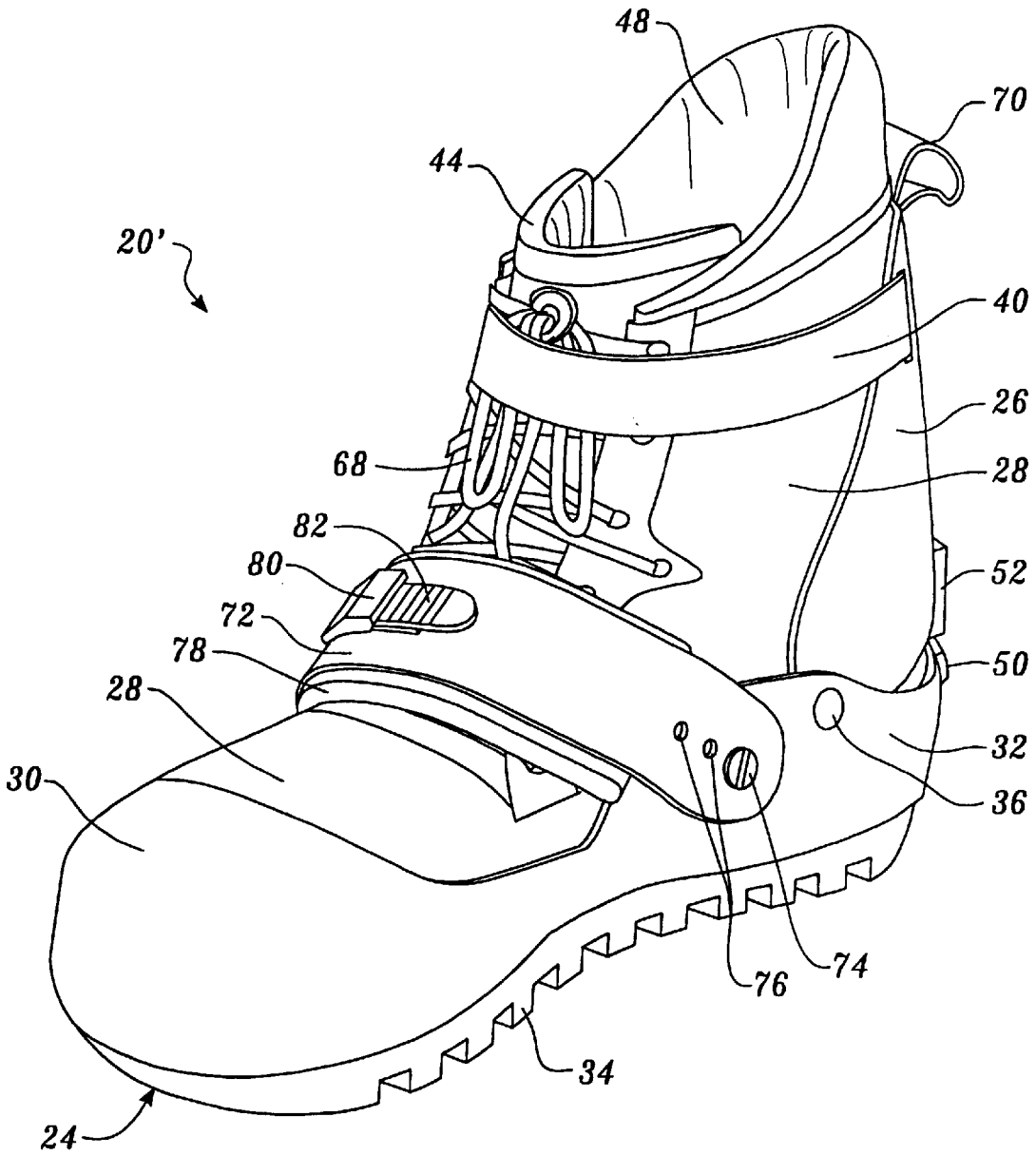
FIG. 7 is a perspective view of another embodiment of the boot of the present invention including both base and highback straps.
Figure 8:
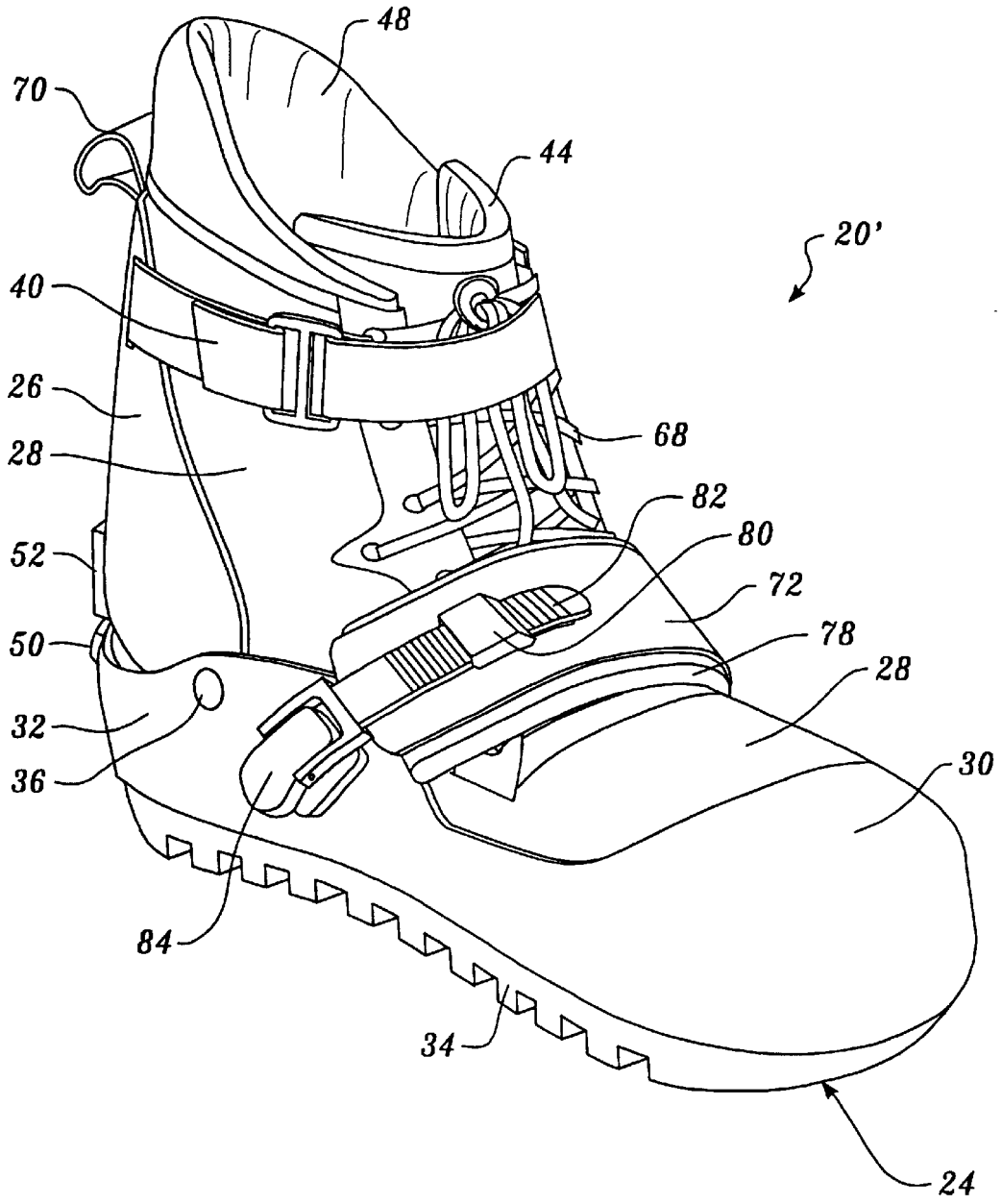
FIG. 8 is a perspective view of the boot illustrated in FIG. 7, showing the opposite side of the boot.
Figure 9:
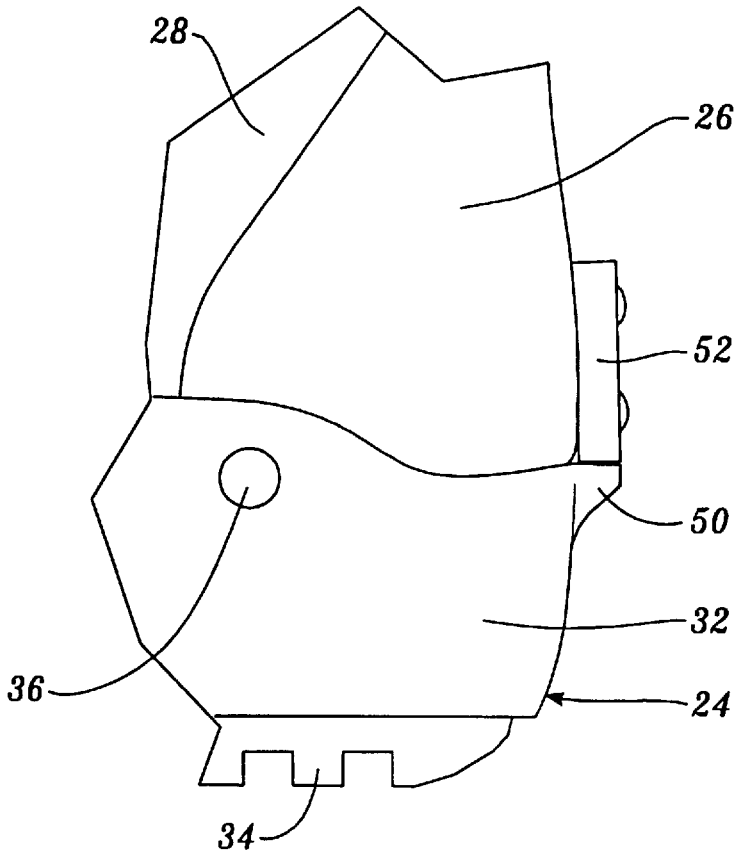
FIG. 9 is a side elevational view of the heel of the boot of FIGS. 7 and 8, illustrating the back stops that limit aft movement of the highback.

An alternate embodiment of boot 20 is illustrated in FIGS. 7 through 9. The major differences between this embodiment and that illustrated in FIGS. 1 through 3 will now be discussed. Besides its generally bulkier appearance due to increased insulation and thickness of materials for added durability, boot 20' also includes exposed laces 68, a loop 70, and a base strap 72. Although a lace cover could alternatively be used, laces 68 are exposed and extend to the top of upper 28 of boot 20'. Loop 70 is attached to the back of upper 28. Loop 70 is preferably formed of leather. The function of loop 70 is simply to aid the user in putting on boot 20'.

Boot 20' also includes base strap 72 connected to the opposing sides of base 24 and extending over the top of upper 28 in front of the ankle of the user. Heel counter 32 actually extends forward for attachment of base strap 72. Heel counter 32 distributes the pressure to the heel end of base 24 of boot 20' A strap fastener 74 secures base strap 72 on the inside and a buckle 84, ratchet 80, and serrated base strap 82 secure base strap 72 on the outside. Strap fastener 74 is a standard screw fit within a receiving sleeve (not shown) engaged within base 24. Adjustment holes 76 are provided along the end of base strap 72 for major adjustments of base strap 72 by fastening a different hole with strap fastener 74. Base strap 72 is preferably constructed of a strong plastic or composite material, but may alternatively be metal, leather, or other material that can withstand the forces involved. Strap padding 78 is attached to the underside of base strap 72. Strap padding 78 is formed from foam with a urethane cover.

Buckle 84 is riveted to the opposite side of heel counter 32. Buckle 84 secures serrated base strap 82 and provides leverage for tightening base strap 72. Alternatively, other types of buckles or tightening devices could be used. With the buckle arrangement shown in FIG. 8, base strap 72 is tightened by elevating buckle 84, sliding serrated base strap 82 a desired distance within ratchet 80, and closing buckle 84.

Another difference between boot 20' illustrated in FIG. 7 and boot 20 illustrated in FIGS. 1 through 3 is the configuration of highback 26. Highback 26 of boot 20' does not have a cuff extending around the front of upper 28. This allows for more lateral flexibility of boot 20' while still providing complete aft support. Some additional support to upper 28 is provided by highback strap 40, which, in this embodiment, is simply a strap with a hook-and-loop fastener extending from slots in highback 26. Highback 26 slightly recedes from the sides of upper 28 as highback 26 extends upwardly along the back of upper 28 to allow increased lateral flexibility.

FIG. 9 illustrates the back of boot 20' and shows stop block 52 and bottom lip 50 in greater detail. Stop block 52 and bottom lip 50 are substantially the same in the embodiment shown in FIGS. 1 through 3. Stop block 52 is held with two fasteners that can be removed for removal or reversal of block 52. Block 52 extends further from the holes on one side than the other such that reversal changes the forward-lean angle of highback 26. Other conventional forward-lean adjustment systems may also be used.

Figure 10:
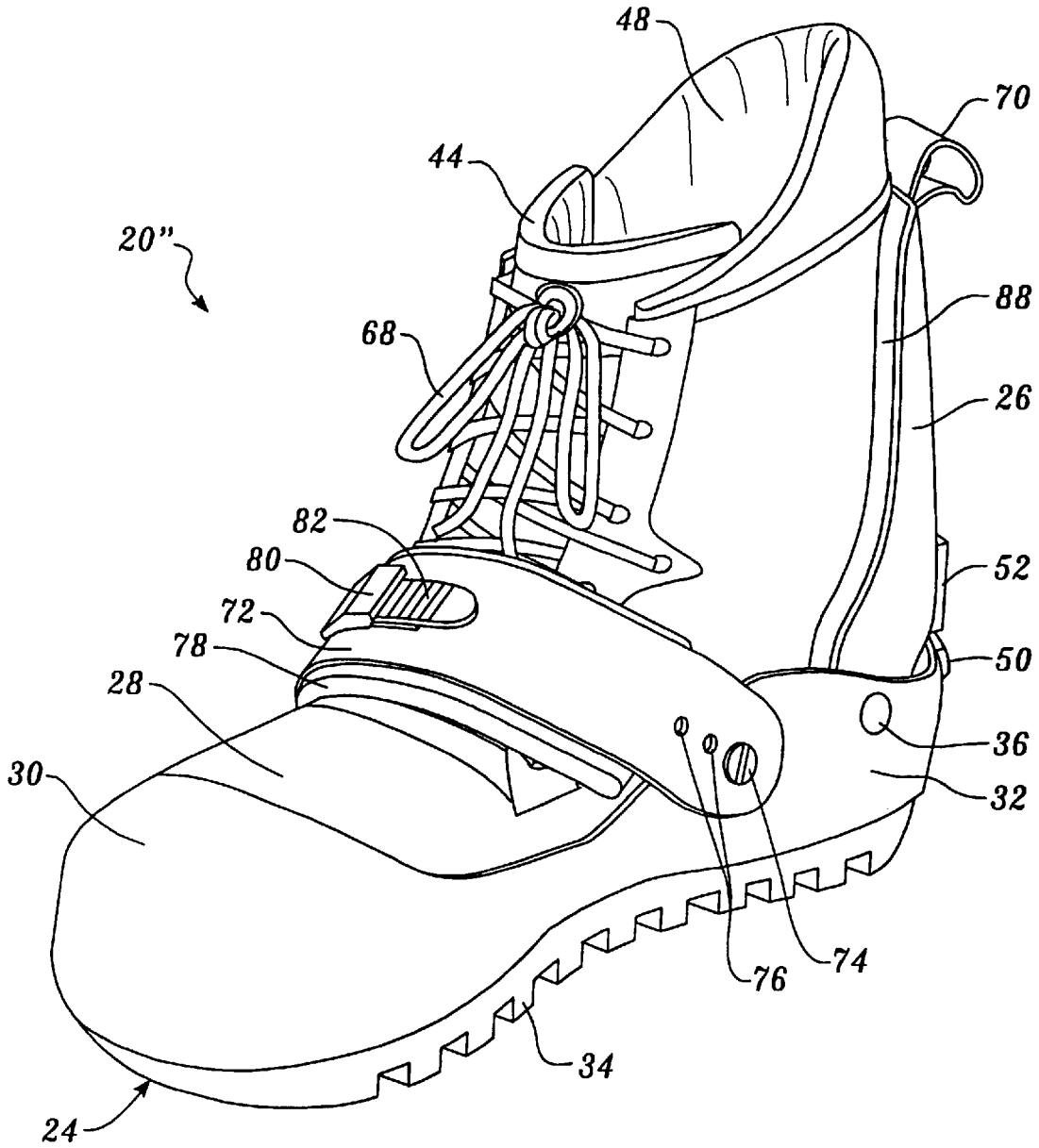
FIG. 10 is a perspective view of an alternate embodiment of the boot of the present invention having no highback strap.

Referring now to FIG. 10 another alternate embodiment of the present invention will be discussed. Boot 20" illustrated in FIG. 10 varies from boot 20' of FIG. 7 by changes made to highback 26. Highback 26 does not include a strap and does not extend as far around the side of upper 28. Thus greater lateral flexibility is provided. Highback pivot 36 is also shifted slightly farther toward the rearward end of heel counter 32. Highback padding 88 is attached to the inside surface of highback 26 of boot 20". Highback padding 88 could be added to any embodiment disclosed herein.

Figure 11:
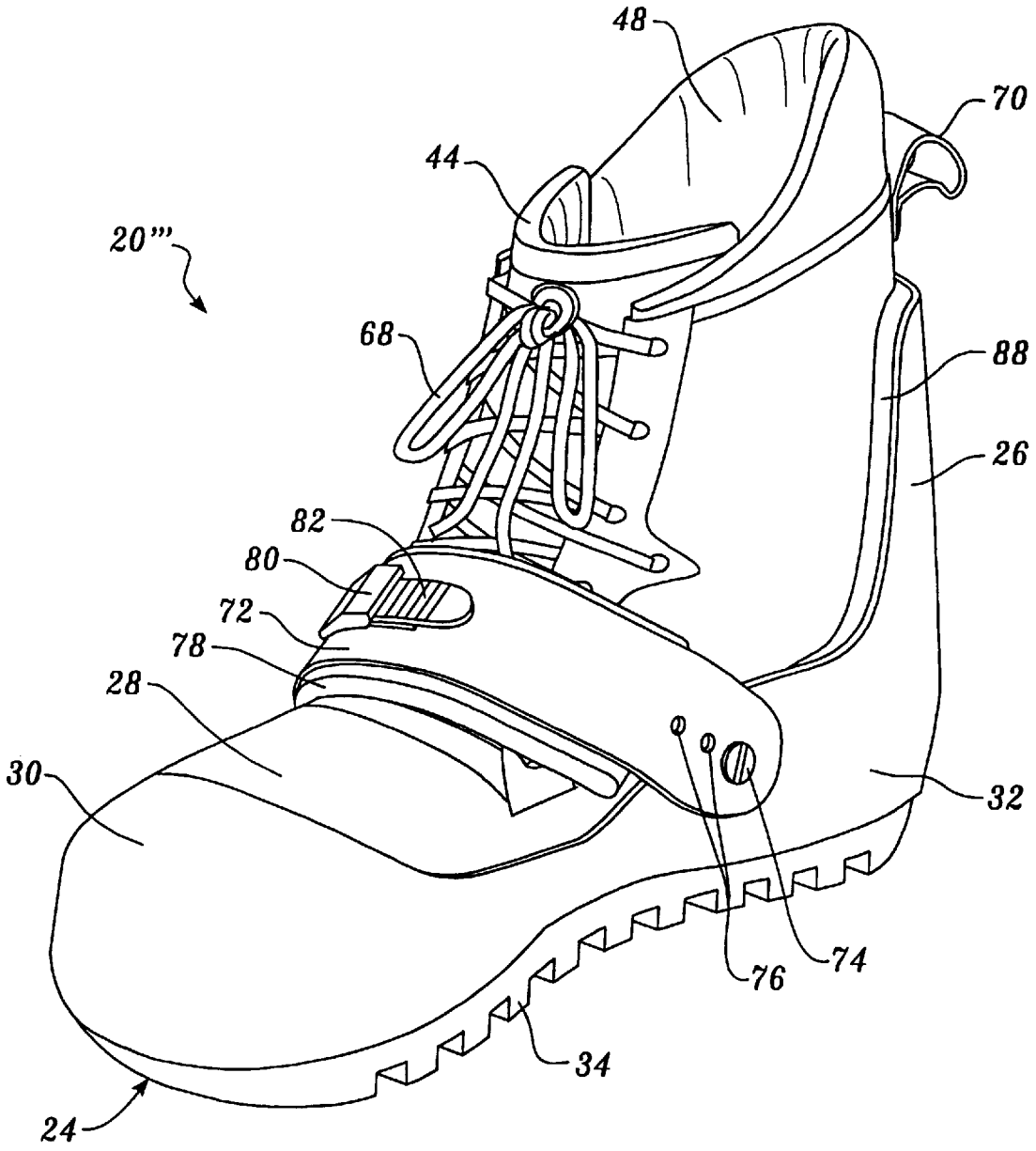
FIG. 11 is a perspective view of another alternate embodiment of the boot of the present invention having an integral highback.

FIG. 11 illustrates another embodiment of the present invention. In this embodiment highback 26 is an integral extension of heel counter 32, instead of being hingeably attached to heel counter 32. A high degree of lateral movement is allowed, while aft movement is restricted by highback 26. A highback strap such as that illustrated in FIG. 7 may be added to increase lateral stiffness as desired. Bottom lip 50 and stop block 52 are not used with the integral highback structure.

The embodiments described above provide numerous advantages to snowboarders over snow boots and mountaineering-type boots. Edge control is achieved due to the support structure of boot 20 including highback 26, base 24, and base strap 72, and other straps disclosed that may also be used. The boot also allows the convenience of a step-in binding. The straps do not have to be undone every time the board is taken off one foot or both since the straps are on the boot itself. The arrangement of the step-in binding can also provide additional lateral flexibility either in the binding itself or as tread 34 compresses and allows slight pivotal movement of boot 20 about the attachment to bindings 64 and 66.

This edge control and step-in convenience are provided while not sacrificing comfort, and freestyle flexibility. The boot is as easy to walk in as a snow boot and has more lateral flexibility for freestyle boarding than a mountaineering-type boot. Depending on which embodiment is used, the lateral flexibility of boot 20 is as great as with a Sorel and a soft binding.

While the preferred embodiments of the invention have been illustrated and described, it will be appreciated that various changes can be made therein without departing from the spirit and scope of the invention. The embodiments shown and described are for illustrative purposes only and are not meant to limit the scope of the invention as defined by the claims.

The embodiments of the invention in which an exclusive property or privilege is claimed are defined as follows:

1. A boot for use with a snowboard, the boot comprising:

(a) a semirigid base having means for attachment to the snowboard, said base providing a walking surface for the user when the boot is detached from the snowboard;

(b) a nonrigid upper attached to said base, said upper being adapted to receive and surround the foot and ankle of a user, said upper being formed of a flexible and pliable material, said upper having a front, a back, and two lateral sides; and (c) a support member attached to and extending upwardly from said base, said support member being disposed adjacent at least a portion of the back of said upper.

2. The boot of claim 1, wherein said support member is constructed of a material with greater rigidity than said upper, said support member providing aft support to said upper.

3. The boot of claim 2, wherein the walking surface of said base comprises a tread portion extending downwardly, away from the foot of the user.

4. The boot of claim 3, wherein said tread portion is flexible such that said tread portion allows limited pivotal movement of said base about the attachment means of said base to the snowboard, thus permitting movement of said boot when coupled to the snowboard.

5. The boot of claim 2, wherein said semi-rigid base is sufficiently flexible such that it allows limited pivotal movement of said base about the attachment means to the snowboard when coupled to the snowboard.

6. The boot of claim 2, wherein said support member comprises a plastic material and includes a strap for securing said support member securely around a portion of said upper.

7. The boot of claim 6, wherein said upper is at least partially constructed of leather.

8. The boot of claim 6, wherein said upper is at least partially constructed of a synthetic mesh material.

9. The boot of claim 2, wherein said base includes a heel counter and wherein said support member extends from said heel counter.

10. The boot of claim 9, wherein said base further includes a toe portion extending at least partially around the sides of the ball of the foot of the user.

11. The boot of claim 9, wherein said support member is pivotally attached to said heel counter.

12. The boot of claim 11, wherein said support member includes a upper stop extending from the back of the support member and wherein said heel counter includes a lower stop extending from the back of the heel counter adjacent the upper stop, said stops being arranged and configured for abutment with each other to limit the aft pivotal movement of the support member relative to the base.

13. The boot of claim 11, further including stop means coupled to said base and to the support member for limiting the aft pivotal movement of the support member relative to the base.

14. The boot of claim 9, further comprising a strap extending from one side of said base over a portion of said upper to the opposing side of said base.

15. The boot of claim 14, wherein said strap includes an adjustable buckle on one end for tightening the strap over a portion of the upper to secure the user's foot.

16. The boot of claim 14, further comprising a strap attached to said support member and extending around at least a portion of said upper for securing said upper to said support member.

17. The boot of claim 9, wherein said heel counter is adapted to cup the heel of the user by extending upwardly from said base around the rear and sides of the heel of the user.

18. The boot of claim 17, wherein the base also includes a tread portion projecting downwardly, away from the foot of the user and attachment means attached to said base for attachment of the boot to a snowboard.

19. The boot of claim 18, wherein the attachment means are positioned within at least one recessed portion of the bottom of the base, the tread portion extending below the attachment means such that the tread portion contacts the ground before the attachment means when the boot is not attached to the snowboard.

20. The boot of claim 19, wherein said base includes a first recessed portion generally beneath the ball of the foot of the user and a second recessed portion generally beneath the heel of the foot of the user, the recessed portions mounting the attachment means.

21. The boot of claim 17, wherein the support means extends upwardly from the rear of the heel counter along the back of the upper, the top of the support member being higher than the ankle of the user.

22. The boot of claim 9, wherein said support member includes attachment means for securing said support member to said upper to provide additional support to said upper and to the ankle of the user.

23. The boot of claim 1, wherein said support member comprises: a highback extending upwardly from a heel end of said base to provide aft support to the user's foot and ankle.

24. The boot of claim 23, further including a base strap connected to opposing sides of said base and extending across a portion of said upper, said base strap being adjustable.

25. The boot of claim 23, further including a highback strap connected to opposing sides of said highback and extending around a portion of said upper.

26. The boot of claim 23, further including a highback strap connected to opposing sides of said highback and extending around a portion of said upper.

27. The boot of claim 23, wherein said base includes a heel counter extending upwardly from the heel end and wherein said highback is pivotally connected to the heel counter.

28. The boot of claim 27, further including stop means connected to the heel counter and to the highback for limiting the aft pivotal movement of said highback relative to the heel counter.

29. The boot of claim 23, wherein said base and said highback are at least partially formed of a rigid plastic material and wherein said upper is formed of a flexible material.

30. A boot for use with a snowboard, the boot comprising:

(a) a base having means for attachment to the snowboard, said base providing a walking surface for the user when the boot is detached from the snowboard;

(b) a nonrigid upper attached to said base, said upper being adapted to receive and surround the foot and ankle of a user, said upper being formed of a flexible and pliable material, said upper having a front, a back, and two lateral sides; and (c) a support member attached to and extending upwardly from said base, said support member being disposed adjacent at least a portion of the back of said upper.

* * * * *

UNITED STATES PATENT AND TRADEMARK OFFICE

CERTIFICATE OF CORRECTION

PATENT NO. : 5,802,741
DATED : September 8, 1998
INVENTOR(S) : B.H. Turner et al.

It is certified that error appears in the above-identified patent and that said Letters Patent is hereby corrected as shown below:

| COLUMN | LINE | |
|---|---|---|
| 10 (Claim 25, line 1) | 19 | "23" should read --24-- |

Signed and Sealed this

Second Day of February, 1999

*Attest:*

*Attesting Officer*

*Acting Commissioner of Patents and Trademarks*